US010876184B2

(12) United States Patent
Chintha et al.

(10) Patent No.: US 10,876,184 B2
(45) Date of Patent: Dec. 29, 2020

(54) HOT ROLLED HIGH STRENGTH STEEL (HRHSS) PRODUCT WITH TENSILE STRENGTH OF 1000-1200 MPA AND TOTAL ELONGATION OF 16%-17%

(71) Applicant: Tata Steel Limited, Jamshedpur (IN)

(72) Inventors: Appa Rao Chintha, Jamshedpur (IN); Monideepa Mukherjee, Jamshedpur (IN); Prashant Pathak, Jamshedpur (IN); Tapas Chanda, Jamshedpur (IN); Gyanaranjan Mishra, Jamshedpur (IN)

(73) Assignee: Tata Steel Limited, Jamshedpur (IN)

( * ) Notice: Subject to any disclaimer, the term of this patent is extended or adjusted under 35 U.S.C. 154(b) by 200 days.

(21) Appl. No.: 15/741,388

(22) PCT Filed: Jan. 23, 2017

(86) PCT No.: PCT/IN2017/000015
§ 371 (c)(1),
(2) Date: Jan. 2, 2018

(87) PCT Pub. No.: WO2017/168436
PCT Pub. Date: Oct. 5, 2017

(65) Prior Publication Data

US 2018/0187283 A1 Jul. 5, 2018

(30) Foreign Application Priority Data

Mar. 30, 2016 (IN) ..... 201631011120

(51) Int. Cl.
*C21D 9/52* (2006.01)
*C22C 38/22* (2006.01)
(Continued)

(52) U.S. Cl.
CPC ..... *C21D 9/52* (2013.01); *B21B 1/22* (2013.01); *C21D 6/002* (2013.01); *C21D 6/005* (2013.01);
(Continued)

(58) Field of Classification Search
CPC ..... C22C 38/22; C22C 38/26; C21D 8/0226
See application file for complete search history.

(56) References Cited

U.S. PATENT DOCUMENTS

2005/0199319 A1* 9/2005 Thomson ..... C21D 8/0226 148/546
2005/0199320 A1* 9/2005 Thomson ..... C21D 8/0226 148/546
(Continued)

FOREIGN PATENT DOCUMENTS

CA 2923585 A1 3/2015
EP 2813595 A1 12/2014

*Primary Examiner* — Sheng H Davis
*Assistant Examiner* — Christopher D. Moody
(74) *Attorney, Agent, or Firm* — The Webb Law Firm

(57) ABSTRACT

A process for making a hot rolled high strength steel (HRHSS) product including the steps of casting a steel slab having, in weight percent, C: 0.18-0.22, Mn: 1.0-2.0, Si: 0.8-1.2, Cr: 0.8-1.2, S: 0.008 max, P: 0.025 max, Al: 0.01-0.15, N: 0.005 max, Nb: 0.02-0.035, Mo: 0.08-0.12, the remainder iron (Fe) and incidental impurities, hot rolling the steel slab into strip at a finish rolling temperature (FRT) of 850-900° C., cooling the hot rolled strip at 40° C./s or more over a run out table (ROT) until the strip reaches 380-400° C., coiling the hot rolled strip, and then air cooling to room temperature.

17 Claims, 4 Drawing Sheets

(51) Int. Cl.

| | |
|---|---|
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 8/02*** | (2006.01) |
| ***C21D 6/00*** | (2006.01) |
| ***C22C 38/26*** | (2006.01) |
| ***C22C 38/18*** | (2006.01) |
| ***B21B 1/22*** | (2006.01) |

(52) U.S. Cl.

CPC ..... *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/18* (2013.01); *C22C 38/22* (2013.01); *C22C 38/26* (2013.01); *B21B 2001/225* (2013.01); *C21D 2211/001* (2013.01); *C21D 2211/008* (2013.01)

(56) References Cited

U.S. PATENT DOCUMENTS

2008/0000555 A1* 1/2008 Nonaka ..... B21B 3/02 148/328
2008/0251160 A1* 10/2008 Akamizu ..... C22C 38/02 148/332
2011/0024004 A1 2/2011 Azuma et al.
2012/0328901 A1 12/2012 Nonaka et al.
2013/0167983 A1* 7/2013 Clarke ..... C21D 6/005 148/541
2014/0027022 A1* 1/2014 Yokoi ..... C21D 6/005 148/541
2014/0056754 A1* 2/2014 Naitou ..... B21D 22/208 420/90
2014/0102600 A1 4/2014 Sourav et al.
2014/0144557 A1* 5/2014 Zhang ..... C21D 8/0263 148/547
2014/0162088 A1* 6/2014 Kawata ..... C22C 38/02 428/659
2014/0251512 A1* 9/2014 Gomez ..... C22C 38/28 148/590
2014/0377582 A1 12/2014 Azuma et al.
2015/0075680 A1* 3/2015 Tanaka ..... C22C 38/38 148/603
2016/0076124 A1* 3/2016 Yamazaki ..... C21D 9/46 148/602
2016/0222485 A1 8/2016 Murakami et al.
2017/0306429 A1* 10/2017 Kurnsteiner ..... C21D 6/005
2018/0237874 A1* 8/2018 Yamazaki ..... C22C 38/20

* cited by examiner (White) Retained austenite and /or martensite (Dark) Bainite ferrite

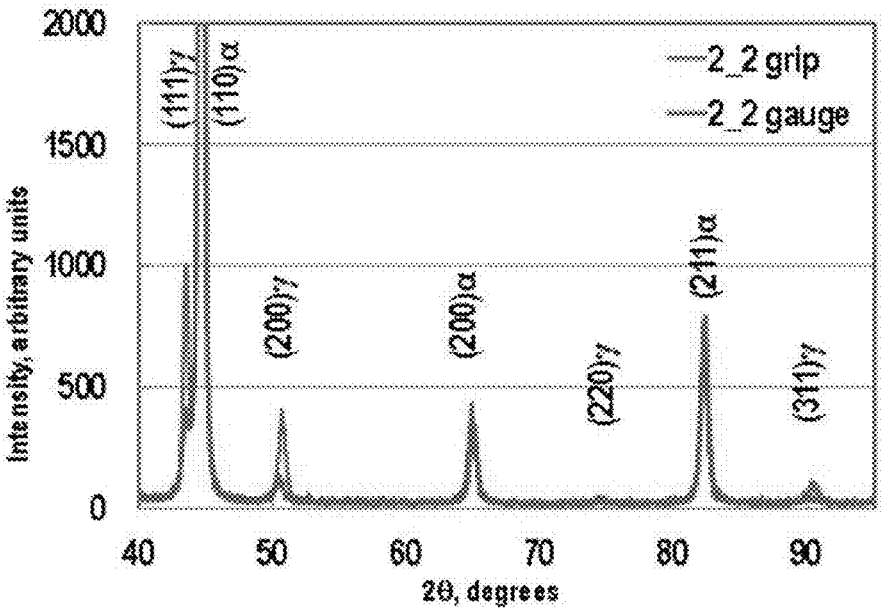
FIG. 6
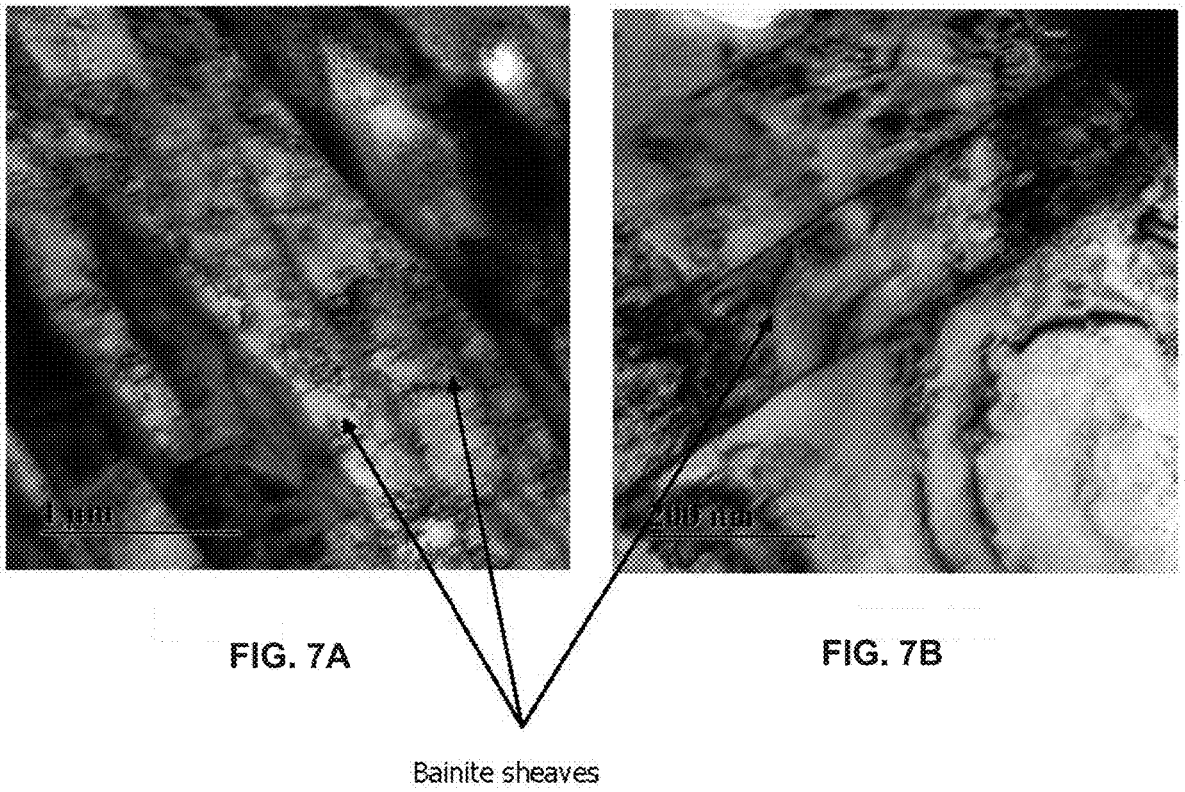
FIG. 7A
FIG. 7B

HOT ROLLED HIGH STRENGTH STEEL (HRHSS) PRODUCT WITH TENSILE STRENGTH OF 1000-1200 MPA AND TOTAL ELONGATION OF 16%-17%

CROSS-REFERENCE TO RELATED APPLICATIONS

This application is the United States national phase of International Application No. PCT/IN2017/000015 filed Jan. 23, 2017, and claims priority to Indian Patent Application No. 201631011120 filed Mar. 30, 2016, the disclosures of which are hereby incorporated in their entirety by reference.

FIELD OF INVENTION

The present invention relates to a hot rolled ultra-high strength steel and method of producing thereof. Particularly, the invention relates to hot rolled ultra-high strength steel adaptable to automotive structural applications, defence equipment applications, lifting and excavation equipment applications.

BACKGROUND

Motor vehicle fuel consumption and resultant emission is one of the major contributors to air pollution. Light-weight environmental friendly vehicle design is required to address the problems of environmental pollution. Successful light-weight motor vehicles require utilization of advanced high strength and ultra-high strength steel (UHSS) sheets. However, because of its poor formability, the UHSS sheet cannot be applied easily to a wide variety of motor vehicle components. Hence, the ductility and formability required for UHSS sheet becomes increasingly demanding. Therefore addressing the present scenario has necessitated development of a hot rolled steel sheet with high tensile strength coupled with excellent uniform elongation and total elongation for automotive component such as lower suspension, long and cross member and bumpers as well.

Such steels have been produced by many researchers where major part of strengthening was due to the nano-structured bainitic ferrite sheaves—famously known as 'nano-bainitic steel' (Bhadeshia, *MSE-A*, Volume 481-482, pp. 36-39, 2008; F. G. Caballero, H. K. D. H. Bhadeshia, K. J. A. Mawella, D. G. Jones and P. Brown, *MST*, Volume 18, pp. 279-284, 2002; C. Garcia-Mateo, F. G. Caballero and H. K. D. Bhadeshia, *ISIJ International*, Volume 43, pp. 1238-1243, 2003). Though they have produced highest strength ever achieved in any bulk material, production of the steel sheet takes about a week due to slower kinetics at mandatory low temperature during coiling of the rolled sheet. Such a long duration during coiling for commercial production is not viable. The second concern is the limited total elongation which is about 7% at a strength range of 2260 MPa. This limited elongation does not allow the steel to be used in wider areas of application where formability is an important aspect. Another issue is related with the alloy composition where the amount of Carbon in steel typically lies in the range of 0.8-1.0 wt. % along with Ni and Co. High Carbon decreases the weldability of the steel and high alloying makes steel expensive.

Another group of researchers (F. G. Caballero, M. J. Santofima, C. Capdevila, C. G. Mateo and C. G. De Andres, *ISIJ International*, Volume 46, pp. 1479-1488, 2006; F. G. Caballero, M. J. Santofima, C. Garcia Mateo, J. Chao and C. Garcia de Andres, *Materials and Design*, Volume 30, pp. 2077-2083, 2009) have been working since then dealing with reducing the amount of C for good weldability and increasing the total elongation. However, the work has not been considered for the production of such steels through continuous production line and also the steels contain high amount of expensive alloying additions like Ni and Mo in their production.

In an effort to meet the demand of present day motor vehicle manufacturers, recent work (Ref. US 2014/0102600 A1) attempted to obtain high strength and ductility combination. This work has successfully achieved minimum 1200 MPa tensile strength with 20% total elongation. However, it has high Carbon (>0.3 wt. %) and Silicon (>1.5 wt. %). High amount of Carbon decreases the weldability and high Silicon causes surface scales during the process of hot rolled steel sheets. These problems are yet to be addressed.

SUMMARY OF THE INVENTION

In view of the foregoing limitations inherent in the prior-art, it is an object of the invention to develop a process for making a hot rolled high strength steel product whose commercial production is viable.

Another object of the invention is that the product having good weldability and lesser scale severity over the product.

Another object of the invention is that the total elongation of the hot rolled high strength steel product ≥16%.

Still another object of the invention is that the tensile strength of the hot rolled high strength steel product ≥1000 MPa.

In one aspect, the invention provides a process for making a hot rolled high strength steel (HRHSS) product comprising steps of casting a steel slab with composition C: 0.18-0.22, Mn: 1.0-2.0, Si: 0.8-1.2, Cr: 0.8-1.2, S: 0.008 max, P: 0.025 max, Al: 0.01-0.15, N: 0.005 max, Nb: 0.02-0.035, Mo: 0.08-0.12 rest iron (Fe) and incidental ingredients (all in wt. percentage), hot rolling the steel slab into strip at finish rolling temperature (FRT) of 850-900° C., cooling the hot rolled strip at 40° C./s or more over run out table (ROT) till it reaches to 380-400° C.; and coiling the hot rolled strip and then air cooling to room temperature.

In one aspect, the invention provides a hot rolled high strength steel (HRHSS) product comprising composition of C: 0.18-0.22, Mn: 1.0-2.0, Si: 0.8-1.2, Cr: 0.8-1.2, S: 0.008 max, P: 0.025 max, Al: 0.01-0.15, N: 0.005 max, Nb: 0.02-0.035, Mo: 0.08-0.12 rest iron (Fe) and incidental ingredients (all in wt. percentage), tensile strength 1000-1200 MPa and total elongation of 16-17%.

BRIEF DESCRIPTION OF THE ACCOMPANYING DRAWINGS

FIG. 6 shows XRD profile of the newly developed HRHSS product which contains about 20% retained austenite by volume in accordance with an embodiment of the invention.

FIGS. 7A and 7B show TEM images of the newly developed HRHSS product showing thin sheaves of bainite in accordance with an embodiment of the invention.

DETAILED DESCRIPTION OF THE INVENTION

Various embodiments of the invention provide a process for making a hot rolled high strength steel (HRHSS) product, the process comprising steps of: casting a steel slab with composition C: 0.18-0.22, Mn: 1.0-2.0, Si: 0.8-1.2, Cr: 0.8-1.2, S: 0.008 max, P: 0.025 max, Al: 0.01-0.15, N: 0.005 max, Nb: 0.02-0.035, Mo: 0.08-0.12 rest iron (Fe) and incidental ingredients (all in wt. percentage); hot rolling the steel slab into strip at finish rolling temperature (FRT) of 850-900° C.; cooling the hot rolled strip at 40° C./s or more over run out table (ROT) till it reaches to 380-400° C.; and coiling the hot rolled strip and then air cooling to room temperature.

Another embodiment of the invention provides a hot rolled high strength steel (HRHSS) product comprising: composition of C: 0.18-0.22, Mn: 1.0-2.0, Si: 0.8-1.2, Cr: 0.8-1.2, S: 0.008 max, P: 0.025 max, Al: 0.01-0.15, N: 0.005 max, Nb: 0.02-0.035, Mo: 0.08-0.12 rest iron (Fe) and incidental ingredients (all in wt. percentage), tensile strength 1000-1200 MPa and total elongation of 16-17%.

Figure 1:
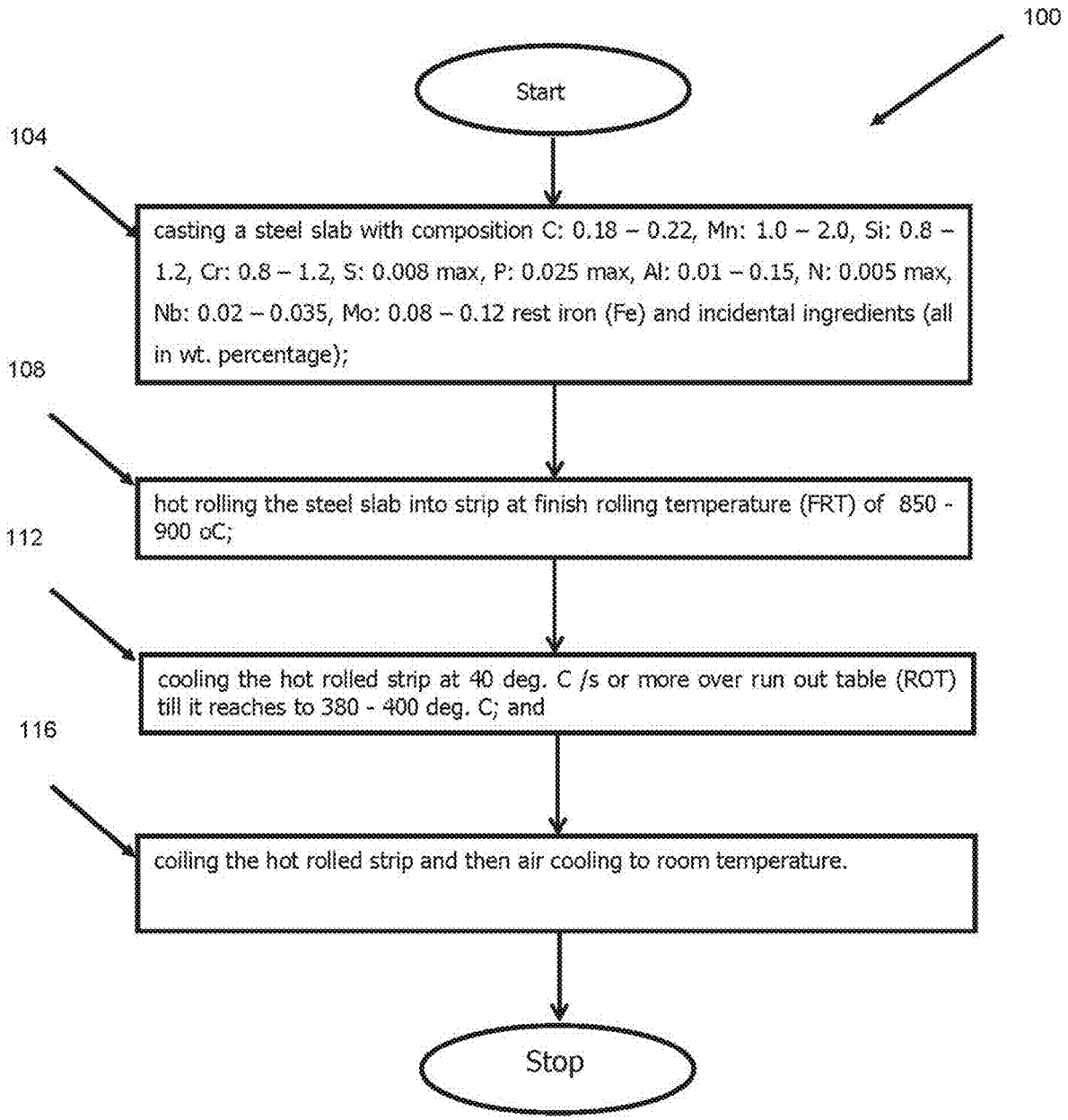
FIG. 1 illustrates various steps of a process for making a newly developed hot rolled high strength steel (HRHSS) product in accordance with an embodiment of the invention.

Shown in FIG. 1 are various steps of a process (100) for making a hot rolled high strength steel (HRHSS) product.

At step (104) a steel slab is casted. The composition and preferable composition of the steel slab is shown in Table 1.

TABLE 1

| Elements | Composition (in wt. %) | Preferable composition |
|---|---|---|
| Carbon (C) | 0.18-0.22 | 0.22 |
| Manganese (Mn) | 1.0-2.0 | 1.48 |
| Silicon (Si) | 0.8-1.2 | 1.0 |
| Chromium (Cr) | 0.8-1.2 | 0.95 |
| Sulphur (S) | 0.008 max | <0.004 |
| Phosphorus (P) | 0.025 max | 0.02 |
| Aluminium (Al) | 0.01-0.15 | 0.14 |
| Nitrogen (N) | 0.005 max | 0.005 |
| Niobium (Nb) | 0.02-0.035 | 0.035 |
| Molybdenum (Mo) | 0.08-0.12 | 0.1 |
| Iron & incidental ingredients | Rest | Rest |

C: (0.18-0.22 wt. %) Adequate amount of carbon is necessary to ensure that the desired strength levels are reached. Carbon also increases stability of retained austenite which is essential to achieve enhanced ductility. For ensuring both strength and ductility are maximized, carbon content is kept preferably at 0.22%. Also at this range of Carbon, the weldability of the steel is good.

Mn: (1.0-2.0 wt. %) Manganese is necessary to stabilize austenite and obtain optimum amount of retained austenite. The amount of Mn needs to be 1.0% or more, preferably 1.3% or more, more preferably 1.48% or more. An excess beyond 2.0% however gives rise to an adverse effects such as a casting crack and hence Mn is preferably controlled to 1.48 wt. %.

Si: (0.8-1.2 wt. %) Silicon is a ferrite stabilizer. It also restricts carbide precipitation during isothermal holding resulting in a larger amount of retained austenite. However, addition of Si leads to surface scale problems during rolling and therefore should be limited to the range mentioned and more preferably at 1.0 wt. %.

Al: (0.01-0.15 wt. %) Aluminum is added because, to an even stronger degree than Si, it is a ferrite stabilizer. Al also suppresses the precipitation of carbon from the retained austenite during the bainitic transformation step, which results in a higher amount of retained austenite. Unlike Si, Al has no detrimental effect on galvanisability.

Preferably, amount of Al should be maintained at 0.14% as higher amount of Al results in problems during casting. Furthermore weldability can deteriorate due to the presence of Al-oxides in the welded area.

P: (0.025 wt. % maximum) Phosphorus content should be restricted to 0.025% maximum and preferably at 0.02%.

S: (0.008 wt. % maximum) The S-content has to be limited otherwise it will result in a very high inclusion level that can deteriorate the formability. Preferably the Sulphur is kept at <0.004 wt. %.

N: (0.005 wt. % maximum) The N content has to be restricted up to 0.005 wt. % maximum, otherwise too much AlN and/or TiN precipitates can form which are detrimental to formability. Preferably the Nitrogen is kept at 0.005 wt. %.

Nb: (0.02-0.035 wt. %) Niobium is added in order to increase the strength of the steel by grain refinement. It also plays a role in increasing the amount of austenite retained in the final microstructure. Preferably, the niobium is kept at 0.035 wt. % to avoid an increase in cost or extra processing difficulties (e.g. rolling forces).

Mo: (0.08-0.12 wt. %) Molybdenum is added to avoid formation of polygonal ferrite and formation of pearlite. Mo also enhances formation of bainite. However, excessive addition of Mo increases the cost of steel processing and hence it is preferably restricted to 0.1 wt. %.

Cr: (0.8-1.2 wt. %) Chromium, similar to Mo, avoids formation of polygonal ferrite and pearlite. It is an economical alloying element addition in UHSS steels. However, excessive addition of Cr will form complex carbides of Cr, hence it is preferably kept at 0.95 wt. %.

The steel slab before being hot rolled is soaked at temperature about 1250 Deg. C. Steel is held at this temperature for sufficient time for the formation of homogenous structure and composition throughout its mass. The soaking time depends on the thickness of the work piece and the steel composition. Higher temperatures and longer soaking times are required for larger cross sections.

At step (108) the steel slab is hot rolled into strip at finish rolling temperature (FRT) of 850-900° C. The temperature is above ferrite transformation start temperature.

At step (112) the hot rolled strip is cooled at 40° C./s or more over run out table (ROT) till it reaches to 380-400°. It is to avoid formation of diffusional phase transformation product like ferrite and pearlite.

At step (116) the hot rolled strip is coiled and air cooled at room temperature. This step allows austenite to bainite transformation during the bainite transformation carbon gets rejected to neighboring austenite phase. The enriched austenite becomes stable at room temperature.

Following are the properties of the HRHSS product obtained:

Yield stress=600-650 MPa

Tensile strength=1000-1200 MPa

Total elongation=16-17% with uniform elongation ≥9%

Strain hardening exponent ("n")=0.15-0.16

The HRHSS product obtained has the bainitic ferrite as the predominant phase and retained austenite as secondary phase. Some amount of unavoidable martensite is also present in the steel. The microstructural characteristics of the hot rolled steel sheet produced according to the present invention are described below.

Bainitic Ferrite [75-80% by vol.]: The bainitic ferrite present in the microstructure is essentially with carbide or carbide free bainite with high dislocation density. It has lath morphology. The higher dislocation density results in higher strength but at the same time ductility is reduced.

Retained Austenite [15-20% by vol.]: Retained austenite is the most important constituent of the microstructure of the HRHSS product developed. On deformation, retained austenite transforms to martensite, resulting in a continuously increasing strain hardening exponent which delays the onset of necking and ensures enhanced ductility (the TRIP effect). For effective TRIP, the amount of retained austenite should be at least 10% and preferably 12% or higher. But a very high volume fraction may lead to a degradation of local deformability and hence the retained austenite is maintained less than or equal to 20%.

Martensite: <5% (including 0% by vol.): The HRHSS product produced may contain some martensite, which may be left present during the manufacturing process (100).

The HRHSS product possesses bainitic sheaves with thickness less than 200 nm. Strength of the steel depends on thickness of bainite sheaves lesser the thickness, higher is the strength.

EXAMPLES

The above mentioned process for making HRHSS product can be validated by the following examples. The following examples should not be construed to limit the scope of invention.

A 25 kg heat was made for processing. Its composition is given in Table 1 (preferable composition). Subsequently, the heat was forged to 25 mm thickness and cooled to room temperature in an open atmosphere. The steel then soaked at 1250° C. for 30 min. before rolling. To ensure the completion of rolling within the austenite range, the finish rolling temperature was kept at finishing rolling temperature of 850° C. During rolling, thickness of the strip was reduced to 4 to 6 mm after two passes. The rolled sheets were then cooled at 40 deg. C per sec and held in a salt bath maintained at the temperature of 380-400° C. for one hour and then naturally cooled to room temperature to simulate the coiling process.

After the samples were cooled down to the room temperature, samples were cut for different characterization experiments (microstructural and mechanical). No additional heat treatment or process was carried out after cooling to room temperature.

Figure 2:
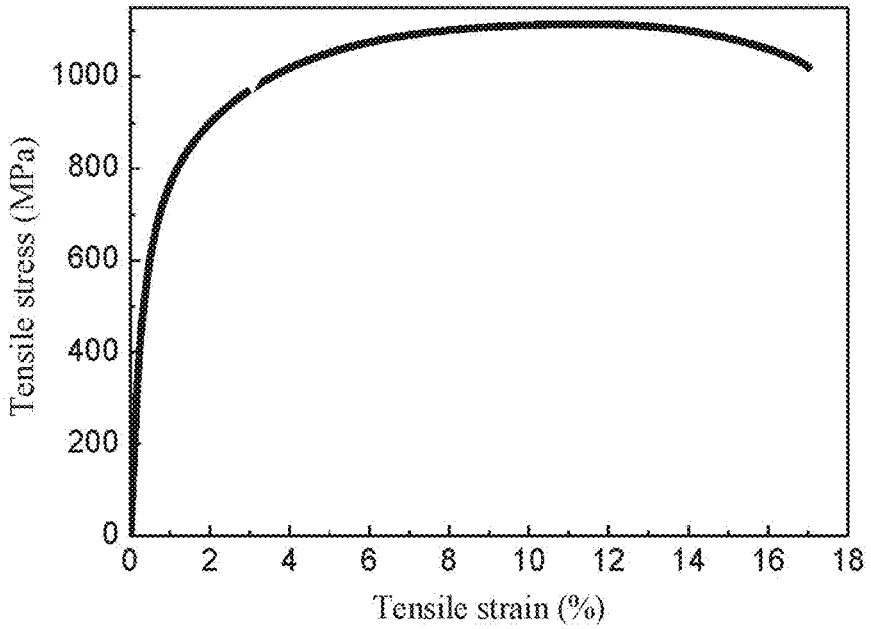
FIG. 2 shows tensile stress-strain plot of the newly developed hot rolled high strength steel (HRHSS) product in accordance with an embodiment of the invention.
Figure 3:
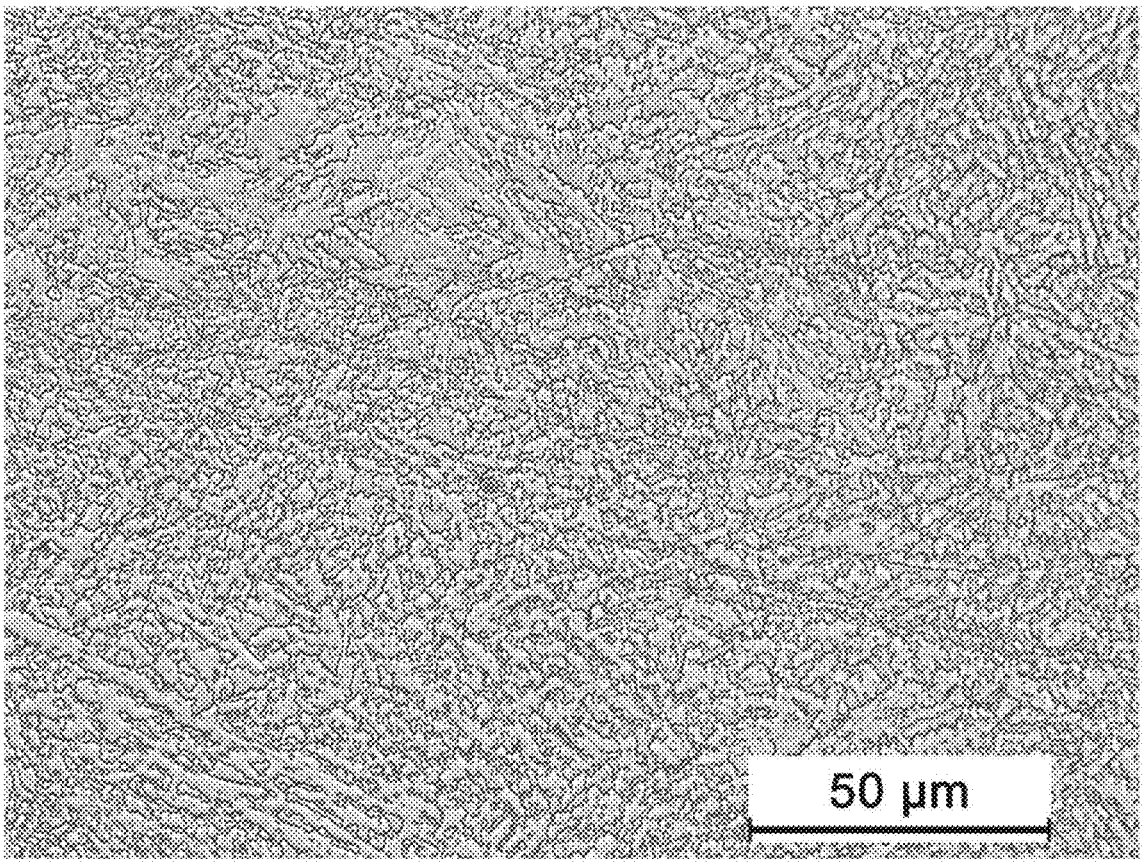
FIG. 3 shows optical microstructure (Nital etched) of the newly developed HRHSS product in accordance with an embodiment of the invention.
Figure 4:
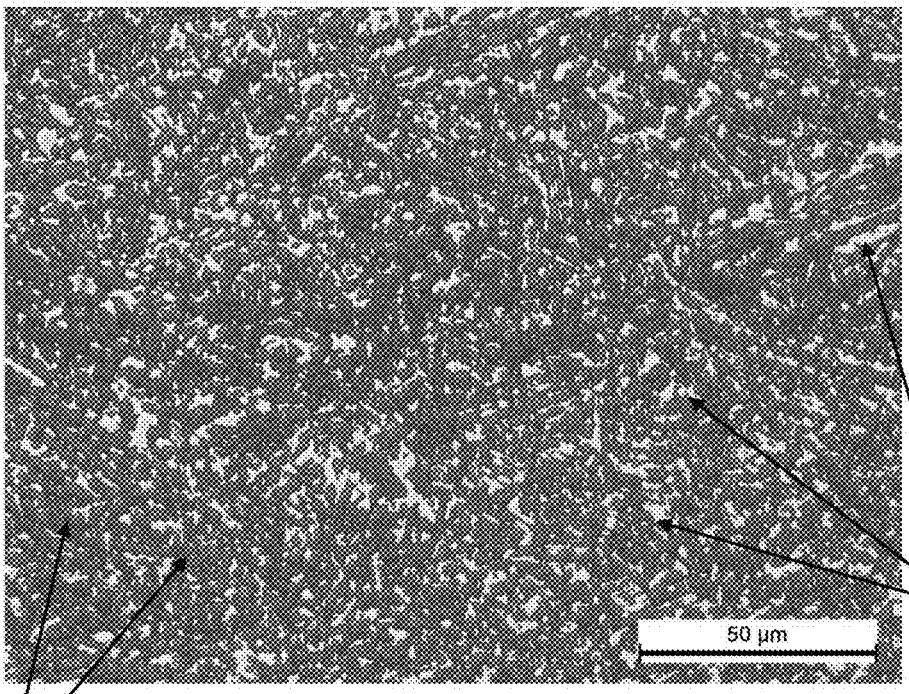
FIG. 4 shows an Optical microstructure (Le pera etched) of the newly developed HRHSS product in accordance with an embodiment of the invention.
Figure 5A:
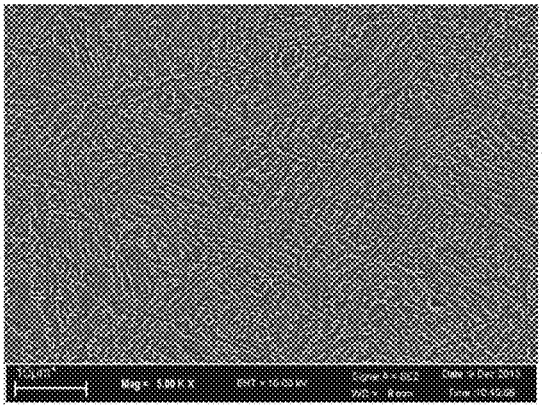
FIGS. 5A and 5B show photographs of the newly developed HRHSS product taken at higher magnification using Scanning Electron Microscopy (SEM) at lower magnification: 5000× and at higher magnification: 25000× respectively in accordance with an embodiment of the invention.
Figure 5B:
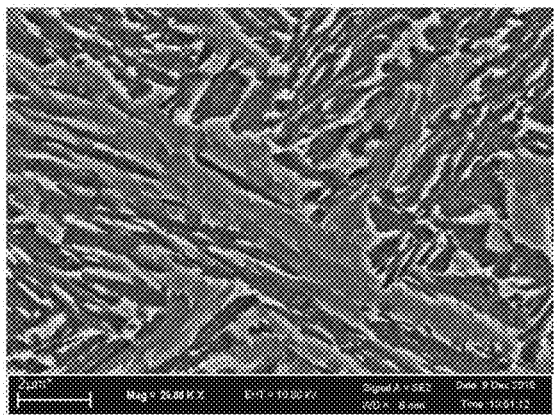

The optical (both Nital and Le pera etched) and SEM microstructures are presented in FIGS. 3, 4, 5A, and 5B which consist of bainitic ferrite, retained austenite and/or martensite. Tensile test samples with 50 mm gauge length were cut according to ASTM E8 standard. Typical tensile test plot is given in FIG. 2. Mechanical properties of the newly developed steel are given in Table 2.

TABLE 2

| Sample No | Width, mm | Thickness, mm | Gauge length, mm | YS (MPa) | Tensile Strength (MPa) | Uniform elongation (%) | Total elongation (%) | Strain hardening coeff. (n) |
|---|---|---|---|---|---|---|---|---|
| 2_1 | 12.58 | 5.05 | 50.44 | 618 | 1115 | 9 | 16 | 0.15 |
| 2_2 | 12.62 | 5.33 | 49.63 | 625 | 1114 | 10 | 17 | 0.16 |

It is evident from the figure and table that newly developed steel has minimum 1100 MPa tensile strength, 9% uniform elongation and minimum 16% total elongation. The newly developed steel also has high strain hardening coefficient i.e., 0.15.

The volume fraction and the lattice parameter of retained austenite were calculated from the X-ray diffraction (XRD) data by a method described by B. D. Cullity, 1978, D. J. Dyson and B. Holmes, 1970. Samples were cut from tensile test sample (after completing the test) from gauge and grips are for XRD analysis. XRD plot is shown in FIG. 6. The curves with the peaks 111, 200, 220 and 311 indicate the presence of retained austenite and the same has been quantified. The curve with the peaks 110, 200 and 211 indicate the presence of bainite ferrite.

Quantitative results are given in Table 3.

TABLE 3

| | Grip area of Tensile sample | | Gauge area of Tensile sample | |
|---|---|---|---|---|
| Sample No | Volume fraction of Austenite($f_\gamma$) | C in Austenite., wt. % | Volume fraction of Austenite($f_\gamma$) | C in Austenite., wt. % |
| 2_1 | 0.20 | 0.81 | 0.10 | 0.70 |
| 2_2 | 0.17 | 0.66 | 0.07 | 0.62 |

It can be noticed that retained austenite in the newly developed steel is as high as 20% by volume.

It's found that the thickness of bainite sheaves is less than 200 nm. High magnification Transmission Electron Microscopy images are shown in FIGS. 7A and 7B.

Advantages:

The production of the HRHSS is commercial viable. The product has good weldability and lesser scale severity. The total elongation of the product obtained is >15%. The tensile strength of the product is >1000 MPa.

We claim:

1. A hot rolled high strength steel (HRHSS) sheet comprising, in weight percent:

C: 0.18-0.22, Mn: 1.0-2.0, Si: 0.8-1.2, Cr: 0.8-1.2, S: 0.008 max, P: 0.025 max, Al: 0.01-0.15, N: 0.005 max, Nb: 0.02-0.035, Mo: 0.08-0.12, a remainder iron (Fe) and incidental impurities, wherein the steel sheet has a tensile strength of 1000-1200 MPa and, a total elongation of ≥16%, and a microstructure in the as-hot rolled condition comprises 75-80% by volume bainitic ferrite and 12-20% by volume retained austenite.

2. The hot rolled high strength steel (HRHSS) sheet as claimed in claim 1, wherein the steel sheet comprises, in weight percent:

C: 0.22, Mn: 1.48, Si: 1.0, Cr: 0.95, S: <0.004, P: 0.02, Al: 0.14, N: 0.005, Nb: 0.035, Mo: 0.1, the remainder iron (Fe) and incidental impurities.

3. The hot rolled high strength steel (HRHSS) sheet as claimed in claim 1, wherein a yield stress of the steel sheet is 600-650 MPa.

4. The hot rolled high strength steel (HRHSS) sheet as claimed in claim 1, wherein uniform elongation of the steel sheet is ≥9%.

5. The hot rolled high strength steel (HRHSS) sheet as claimed in claim 1, wherein a strain hardening exponent ("n") of the steel sheet is 0.15-0.16.

6. The hot rolled high strength steel (HRHSS) sheet as claimed in claim 1, wherein a microstructure of the steel sheet comprises 15%-20% by volume retained austenite.

7. The hot rolled high strength steel (HRHSS) sheet as claimed in claim 1, wherein a microstructure of the steel sheet comprises <5% martensite by volume.

8. The hot rolled high strength steel (HRHSS) sheet as claimed in claim 1, wherein a microstructure of the steel sheet comprises bainitic sheaves with a thickness less than 200 nm.

9. A process for making a hot rolled high strength steel (HRHSS) sheet according to claim 1, the process comprising steps of:

casting a steel slab with a composition comprising in weight percent C: 0.18-0.22, Mn: 1.0-2.0, Si: 0.8-1.2, Cr: 0.8-1.2, S: 0.008 max, P: 0.025 max, Al: 0.01-0.15, N: 0.005 max, Nb: 0.02-0.035, Mo: 0.08-0.12, a remainder iron (Fe) and incidental impurities;

hot rolling the steel slab into a hot rolled strip at a finish rolling temperature (FRT) of 850-900° C.;

cooling the hot rolled strip at 40° C./s or more over a run out table (ROT) until the hot rolled strip reaches 380-400° C.; and coiling the hot rolled strip and then air cooling to room temperature.

10. The process for making the hot rolled high strength steel (HRHSS) sheet as claimed in claim 9, wherein the composition of the steel sheet comprises in weight percent C: 0.22, Mn: 1.48, Si: 1.0, Cr: 0.95, S: <0.004, P: 0.02, Al: 0.14, N: 0.005, Nb: 0.035, Mo: 0.1, a remainder iron (Fe) and incidental impurities.

11. The process for making the hot rolled high strength steel (HRHSS) sheet as claimed in claim 1, wherein a yield stress of the steel sheet is 600-650 MPa.

12. The process for making the hot rolled high strength steel (HRHSS) sheet as claimed in claim 9, wherein a total elongation of the steel sheet is 16%-17%.

13. The process for making the hot rolled high strength steel (HRHSS) sheet as claimed in claim 9, wherein uniform elongation of the steel sheet is ≥9%.

14. The process for making the hot rolled high strength steel (HRHSS) sheet as claimed in claim 9, wherein a strain hardening exponent ("n") of the steel sheet is 0.15-0.16.

15. The process for making the hot rolled high strength steel (HRHSS) sheet as claimed in claim 9, wherein a microstructure of the steel sheet comprises 15%-20% retained austenite by volume.

16. The process for making the hot rolled high strength steel (HRHSS) sheet as claimed in claim 9, wherein a microstructure of the steel sheet comprises <5% martensite by volume.

17. The process for making the hot rolled high strength steel (HRHSS) sheet as claimed in claim 9, wherein a microstructure of the steel sheet possesses bainitic sheaves with thickness less than 200 nm.

* * * * *